US008105173B2

(12) United States Patent
Connors et al.

(10) Patent No.: US 8,105,173 B2
(45) Date of Patent: Jan. 31, 2012

(54) ADJUSTABLE HEIGHT SLIDE BASE

(75) Inventors: Christopher W. Connors, Draper, UT (US); Ernie D. Sheets, Amarillo, TX (US)

(73) Assignee: Backyard Leisure Holdings, Inc., Pittsburg, KS (US)

( * ) Notice: Subject to any disclaimer, the term of this patent is extended or adjusted under 35 U.S.C. 154(b) by 59 days.

(21) Appl. No.: 12/577,610

(22) Filed: Oct. 12, 2009

(65) Prior Publication Data

US 2011/0086717 A1 Apr. 14, 2011

(51) Int. Cl.
*A63G 21/00* (2006.01)
*A63G 21/18* (2006.01)

(52) U.S. Cl. ..... 472/116; 472/117; 482/35

(58) Field of Classification Search ..... 476/116–117; 104/69–70; 482/34, 35, 140, 142, 146; 248/188.2, 248/188.8
See application file for complete search history.

(56) References Cited

U.S. PATENT DOCUMENTS 4,487,411 A * 12/1984 Ahrens ..... 472/116
4,759,450 A 7/1988 Ball et al.
5,158,512 A * 10/1992 Irwin et al. ..... 482/52
5,269,735 A * 12/1993 Pfitzenmeier ..... 482/52
D361,631 S 8/1995 King
D371,414 S 7/1996 King
D375,775 S 11/1996 King
D375,776 S 11/1996 King
D378,394 S 3/1997 King
D378,845 S 4/1997 King
5,672,144 A * 9/1997 Hulme ..... 482/140
5,733,225 A 3/1998 Watermiller et al.
5,938,535 A 8/1999 King
6,475,117 B1 11/2002 Berglund et al.
6,524,355 B1 * 2/2003 Jenkins ..... 482/52
6,988,952 B1 * 1/2006 Hagerty ..... 472/116
7,253,951 B2 * 8/2007 Bolland ..... 359/402
D575,840 S 8/2008 Sammann et al.
D601,220 S 9/2009 Sammann et al.
7,662,045 B2 2/2010 Sammann et al.
7,770,811 B2 * 8/2010 Belding ..... 238/10 R
2007/0049384 A1 3/2007 King et al.
2008/0032807 A1 2/2008 King et al.

* cited by examiner

*Primary Examiner* — Kien Nguyen

(74) *Attorney, Agent, or Firm* — Hovey Williams LLP

(57) ABSTRACT

A playset is operable to be erected on a site and includes a slide and an adjustable-height slide base. The slide base includes an adapter that attaches below the slide and at least one standoff that attaches below the adapter.

15 Claims, 9 Drawing Sheets

ADJUSTABLE HEIGHT SLIDE BASE

BACKGROUND

1. Field

The present invention relates generally to children's playsets often incorporated into playground equipment. More specifically, embodiments of the present invention concern a playset with a slide and an adjustable-height slide base.

2. Discussion of Prior Art

Conventional children's playsets encompass a variety of components that children use for playing and often include a swing set, slide, sandbox, see-saw, merry-go-round, monkey bars, a playhouse, or a combination of such components. Some prior art playground set designs have a modular construction that allows the purchaser to select a group of components for the set depending on cost, space, and other considerations. Prior art playground sets normally require at least some assembly after purchase, including those designed for home use.

Prior art playground equipment suffers from various undesirable limitations. For instance, conventional equipment typically requires a playground site that is flat and level. Where prior art equipment, such as a swing set or slide, is installed on sloping or undulating terrain, the equipment may not be stable and may be prone to undue tipping or rocking movement. Furthermore, prior art playground sets require an undesirable amount of time to assemble the set and often require extensive use of tools to erect and level the set.

There is accordingly a need in the art for playground equipment that can be adapted to undulating terrain and is configured to be stably erected on an undulating site with little or no site preparation work. Moreover, there is a need for playground equipment that can be erected involving minimal time for assembly and leveling of the equipment.

SUMMARY

Embodiments of the present invention provide a slide assembly with an adjustable height slide base that does not suffer from the problems and limitations of the prior art playground equipment set forth above.

A first aspect of the present invention concerns a slide assembly operable to be erected on a site. The slide assembly broadly includes a slide and an adjustable-height slide base. The slide includes a slide section and presents upper and lower ends associated with slide ingress and egress. The adjustable-height slide base supports the slide section and includes an intermediate adapter and a lower standoff stacked in series with the slide section. The slide section presents a lower adapter-mating surface. The adapter presents upper and lower adapter ends, with the upper adapter end being removably mated with the lower adapter-mating surface to be interengaged and generally extend along a common adapter axis. The standoff presents opposite upper and lower standoff ends, with the lower adapter end and the upper standoff end being removably attached relative to one another. The standoff includes a lowermost site-engaging surface that presents a normal site-engaging axis generally normal thereto, with the site-engaging axis being angularly offset from the adapter axis.

A second aspect of the present invention concerns a playset operable to be erected on an uneven site having vertically offset ground areas. The playset broadly includes a climbing frame, a slide, and an adjustable height slide base. The climbing frame is configured to be positioned on a first ground area. The slide includes a lower slide section and presents upper and lower ends associated with slide ingress and egress. The upper slide end is attached to the frame to position the slide in a sloped operational orientation. The lower slide section presents a generally downward facing adapter-mating surface. The adapter-mating surface is positioned at a vertical location when the slide is in the operational orientation. The adjustable height slide base is configured to support the lower slide section on a second ground area that is lower than the first ground area. The slide base includes an intermediate adapter and a plurality of lower standoffs. The adapter engages the adapter-mating surface. At least one of the standoffs is stacked below the adapter to support the adapter on the second ground area, with the number of standoffs stacked below the adapter being determined by the space defined between the second ground area and the adapter-mating surface when the slide is in the operational orientation.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein:

FIG. 1 is a side elevation of a children's playset constructed in accordance with a preferred embodiment of the present invention, with the playset including a tower, a slide that includes slide inlet and exit sections and intermediate slide sections that interconnect the inlet and exit sections, and an adjustable slide base that includes a base adapter and at least one standoff installed below the base adapter;

Figure 1:
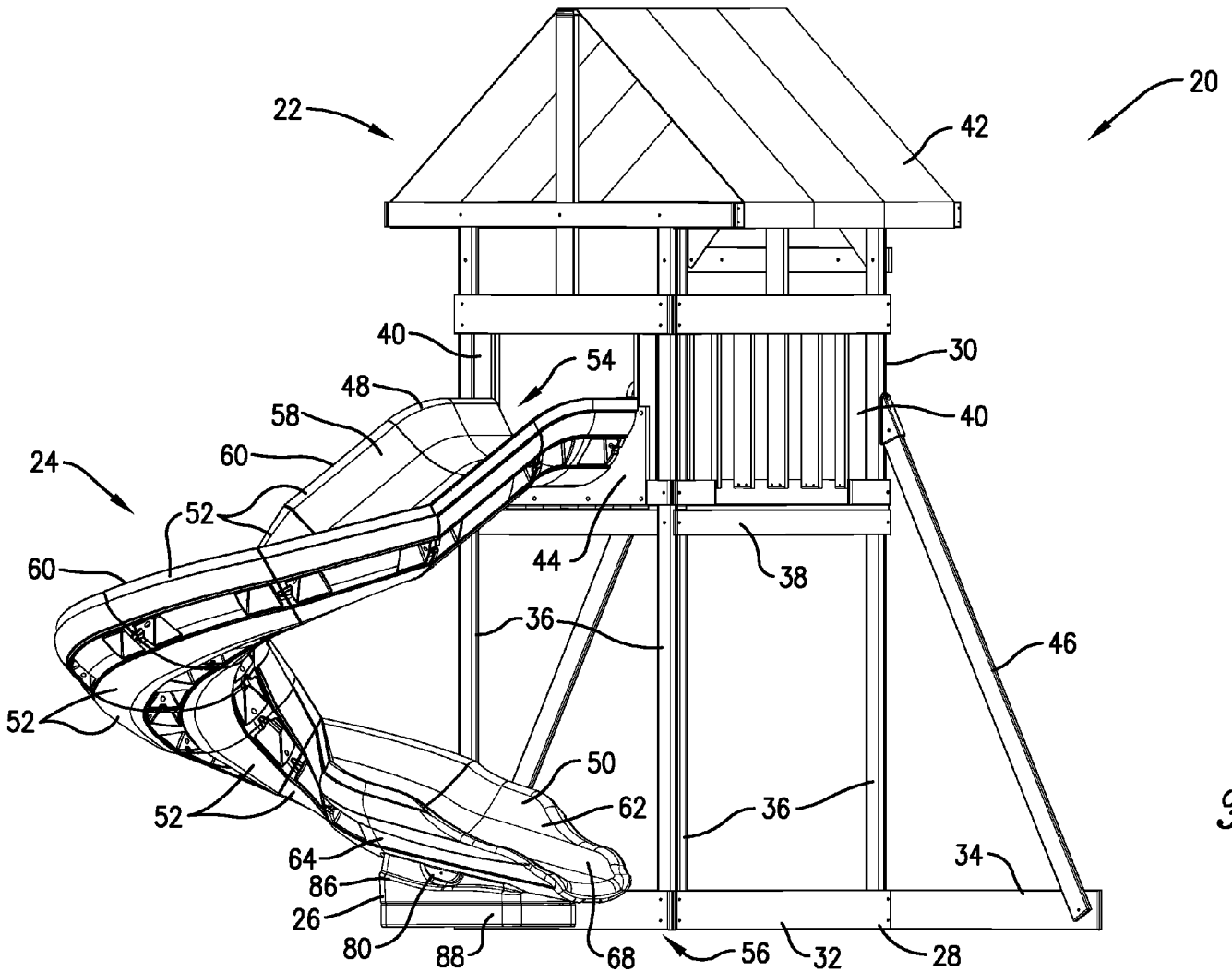

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIG. 1, a children's playset 20 is configured to be mounted on ground G and broadly includes a tower 22, a slide 24, and an adjustable height slide base 26. The slide base 26 adjustably supports a lower end of the slide 24, as will be discussed in greater detail. Moreover, the slide base 26 is preferably configured to properly position and orient the slide 24 regardless of any change in elevation of ground G. As will be shown below, the slide base 26 can properly position the slide 24 when areas of the ground G supporting the tower 22 and slide 24 are at substantially the same vertical location (see FIG. 5) or when the ground areas that respectively support the tower 22 and slide 24 are at a different vertical location, e.g., where the ground area supporting the slide 24 is lower than the ground area supporting the tower 22 (see FIG. 8). Consequently, the illustrated slide base 26 allows the playset 20 to be efficiently installed on terrain that is flat, level, sloping, or undulating. The principles of the present invention are also applicable where the slide base 26 supports another part of the playset 20. Also, the playset 20 could include other components without departing from the scope of the present invention.

The illustrated tower 22 is a conventional structure that provides upper and lower play areas and is operable to support an upper end of the slide 24. The tower 22 broadly includes a tower base 28 and an elevated enclosure 30. The tower base 28 includes a plurality of side boards 32 that are fastened together to present sides of a box structure (e.g., for use as a sandbox) and outrigger boards 34 that project outwardly from opposite sides of the box structure. The enclosure 30 includes upright elongated stanchions 36 that present upper and lower stanchion ends, with the lower stanchion ends being attached to respective corners of the box structure. The enclosure 30 further includes a deck 38, sides 40, and a roof 42 that interconnect the stanchions 36. One of the sides 40 includes a slide support plate 44 that receives the upper end of the slide, as will be discussed. In the usual manner, the tower 22 also includes a ladder (not shown) that extends from the ground G to the deck 38. The tower 22 further includes gusset beams 46 that extend from a location adjacent an outermost end of respective boards 34 to corresponding stanchions 36. The gusset beams 46 serve to restrict the enclosure 30 from tilting relative to the tower base 28 and thereby stabilize the enclosure 30.

Turning to FIGS. 1-7, the slide 24 provides a structure for a child to safely descend from a location proximal to the deck 38 to a location adjacent the ground G that is distally located relative to the deck 38. The illustrated slide 24 preferably includes a proximal-most slide inlet section 48, a distal-most slide exit section 50, and a plurality of intermediate slide sections 52, all of which are preferably constructed of blow-molded synthetic resin. However, for some aspects of the present invention, the slide sections could be constructed of alternative materials or could be made by an alternative manufacturing process.

The slide sections 48,52 are preferably conventional and each present proximal and distal attachment ends that permit connection of the sections 48,52 in an end-to-end fashion with fasteners (not shown) to form the illustrated helical slide shape. However, it is also within the scope of the present invention where the slide 24 presents an alternative shape, e.g., a straight slide that does not twist about an upright axis. Furthermore, the plurality of slide sections 52 could alternatively be formed of a single integrally-formed slide with the desired slide shape. The slide inlet section 48 presents an upper slide ingress end 54 of the slide 24 and the slide exit section 50 presents a lower slide egress end 56 of the slide 24. The sections 48,52 cooperatively present a concave slide surface 58 and opposite slide edges 60 that extend distally along a curvilinear path between the ingress end 54 and the egress end 56. The illustrated slide sections 48,52 present an open top, but one or more of the slide sections 48,52 could include a canopy that covers the path along the corresponding slide section 48,52.

The slide exit section 50 includes upper and lower walls 62,64 that extend laterally between distally tapering scalloped edges 66, with the upper wall 62 presenting a concave slide exit surface 68 extending between proximal and distal ends of the slide exit section 60. The lower wall 64 presents a convex surface 70 and flanges 72 positioned adjacent the proximal end of the slide exit section 60. The lower wall 64 also preferably presents a generally trapezoidal socket 74 spaced between the proximal and distal ends of the slide exit section 60 and defined by a convex adapter surface 76 and shoulders 78 that surround the surface 76. The shoulders 78 extend from the adapter surface 76 to the convex surface 70. The socket 74 presents a socket width that tapers slightly from an aft end of the socket 74 to a fore end of the socket 74. As will be discussed, the socket 74 is configured to receive a complementally shaped male projection of the slide base 26. However, it is also within the scope of the present invention where the slide exit section 50 presents a male projection that is received by a complemental socket of the slide base 26.

The lower wall 64 also preferably includes a pair of attachment tabs 80 that are positioned along opposite sides of the socket 74 and depend below the convex surface 70. The tabs 80 each present a substantially semi-circular margin and are configured to be received in a complementally shaped pocket of the slide base 26, as will be discussed. The tabs 80 also present a through hole 81 that extends laterally through the tab 80 and is configured to receive a fastener for attachment of the slide exit section 50 to the slide base 26. For some aspects of the present invention, the slide exit section 60 could include an alternative number of attachment tabs 80 or be devoid of attachment tabs 80 without departing from the scope of the present invention. For instance, as opposed to the illustrated embodiment, the lower wall 64 could be devoid of tabs and the slide base 26 could include tabs that are received by the lower wall 64. Although the slide exit section 50 is configured for attachment to the slide base 26, certain principles of the present invention are equally applicable where another section of the slide 24 is configured to be attached and thereby supported by slide base 26.

The slide exit section 50 is attached to the distal-most intermediate slide section 52 by positioning the proximal end of the slide exit section 50 along the distal end of the distal-most slide section 52. Furthermore, the flanges 72 are positioned in abutting relationship with flanges 82 of the distal-most intermediate slide section 52, and the flanges 72,82 are secured to one another by threaded fasteners 84 that extend through abutted flanges 72,82 (see FIGS. 4, 7, and 9). The slide exit section 50 is mounted so that the concave slide exit surface 68 presents a continuous extension of the concave slide surface 58. Also, the edges 66 preferably extend continuously from respective slide edges 60. However, it is also within the scope of the present invention where the edges 66 do not extend continuously from edges of the slide 24, e.g., where the slide sections 52 are tubular and do not present slide edges.

Turning to FIGS. 2-9, the adjustable height slide base 26 is configured to support the slide exit section 50 above ground G. However, certain principles of the present invention are applicable whether the slide base 26 supports another part of the playset 20, e.g., one of the slide sections 52. The slide base 26 broadly includes an adapter 86 and standoffs 88. As will be shown in greater detail, the standoffs 88 are preferably substantially identical so that either may be inserted by itself beneath the adapter 86 to present a first height dimension of the slide base 26 (see FIGS. 2-7). Furthermore, the standoffs 88 may be stacked on top of each other (see FIGS. 8 and 9) to provide a second height dimension greater than the first height dimension. For some aspects of the present invention, an alternative number of standoffs 88 can be used in the installation of the playset 20 (e.g., more than two standoffs 88) without departing from the scope of the present invention.

The standoffs 88 each preferably comprise a blow-molded, synthetic resin construction (e.g., polyethylene). For some aspects of the present invention, the standoffs 88 could be molded or formed by another process. The standoffs 88 include upper and lower walls 92,94 and an endless flange 96. In addition, the standoffs 88 include upper fore, aft, and side shoulders 98,100,102 that extend from the upper wall 92 to the flange 96 (see FIGS. 6, 7, and 9). The standoffs 88 also include lower fore, aft, and side shoulders 104,106,108 that extend from the lower wall 94 to the flange 96. The walls 92,94 are also connected by a square tube 110 that presents a central opening 112 (see FIGS. 6 and 7). The standoffs 88 are preferably constructed to present a maximum width W and a maximum length L that are each between about one-half of the maximum cross-sectional width Ws of the slide 24 and the full width Ws (see FIG. 8). More preferably, the maximum width W ranges from about 10 inches to about 20 inches and the maximum length ranges from about 20 inches to about 30 inches. In this manner, the standoffs 88 present a broad footprint that stabilizes the slide 24 by restricting lateral and fore-and-aft tilting of the slide 24 relative to the ground G. Moreover, this broad footprint permits the weight of the slide and a person on the slide to be distributed over a large area, which increases the durability and usable life of the slide base 26. It has been found that the dimensional configuration of the standoffs 88 particularly permits the standoffs 88 to have a thin-walled construction that can be made using conventional blow-molding techniques.

The flange 96, shoulders 98,100,102, and upper wall 92 cooperatively present an upper male standoff end 114. The flange shoulders 104,106,108, and lower wall 94 cooperatively present a lower female standoff end 116 with a centrally located socket that is surrounded by the flange 96. The standoff ends 114,116 present corresponding upper and lower standoff axes SA1,SA2. The upper standoff axis SA1 is substantially normal to corresponding upwardly facing surfaces of the upper wall 92 and the flange 96. The lower standoff axis SA2 is substantially normal to corresponding downwardly facing surfaces of the lower wall 94 and flange 96. Preferably, the standoff axes SA1,SA2 are parallel to each other, but the standoffs 88 could also be configured to present an oblique angle therebetween. Thus, the standoff ends 114,116 are preferably configured so that the standoff 88 uniformly increases the height of the adapter 86, as will be discussed further. In addition, the standoffs 88 each preferably present a stacking height H with a dimension that ranges between about one tenth (1/10) of the width W and the full width W (see FIGS. 4 and 5). More preferably, the stacking height H ranges between about one (1) inch and about twelve (12) inches and, most preferably, the stacking height H of standoffs 88 is about three (3) inches. However, it is also within the scope of the present invention where each standoff 88 presents a different stacking height H. The stacking height H of the illustrated standoffs 88 promotes stability and restricts tipping of the slide 24.

The standoffs 88 are preferably substantially identical in shape. In this manner, the standoffs 88 can be used interchangeably and can also be stacked on top of each other to support the adapter 86 while providing additional space between the adapter 86 and the ground G (see FIGS. 8 and 9). However, it is also within the ambit of the present invention where the standoffs 88 are alternatively and variously constructed or shaped, e.g., where the standoff ends 114,116 are alternatively configured for connection to the adapter 86 and for engagement with the ground G.

Turning to FIGS. 2-7, the adapter 86 interconnects one of the standoffs 88 and the slide exit section 50 to support the slide 24. However, certain principles of the present invention are applicable where the adapter 86 is attached to another part of the slide 24. Furthermore, the adapter 86 could be configured to support another part of the playset 20.

The adapter 86 preferably comprises a unitary, blow-molded, synthetic resin construction. But for some aspects of the present invention, the adapter 86 could be molded or formed by another process. The adapter 86 includes upper and lower walls 118,120 that taper toward each other, as will be discussed further. The adapter 86 also includes an endless flange 122 and a sidewall 124 that interconnects the flange 122 and the upper wall 118 (see FIGS. 6, 7, and 9). The lower wall 120 is positioned above a lower edge of the flange 122, with the flange 122 presenting inwardly facing fore, aft, and side shoulders 126,128,130. The flange 122, shoulders 126, 128,130, and lower wall 120 cooperatively present a female adapter end 132. The sidewall 124 presents outwardly facing fore, aft, and side shoulders 134,136,138 extending from the upper wall 118 to the flange 122, with the flange 122, shoulders 134,136,138, and upper wall 118 cooperatively presenting a male adapter end 140. The adapter ends 140,132 present respective upper and lower adapter axes AA1,AA2 that extend in a generally normal direction from the corresponding surface of the lower and upper walls 120,118.

Figure 2:
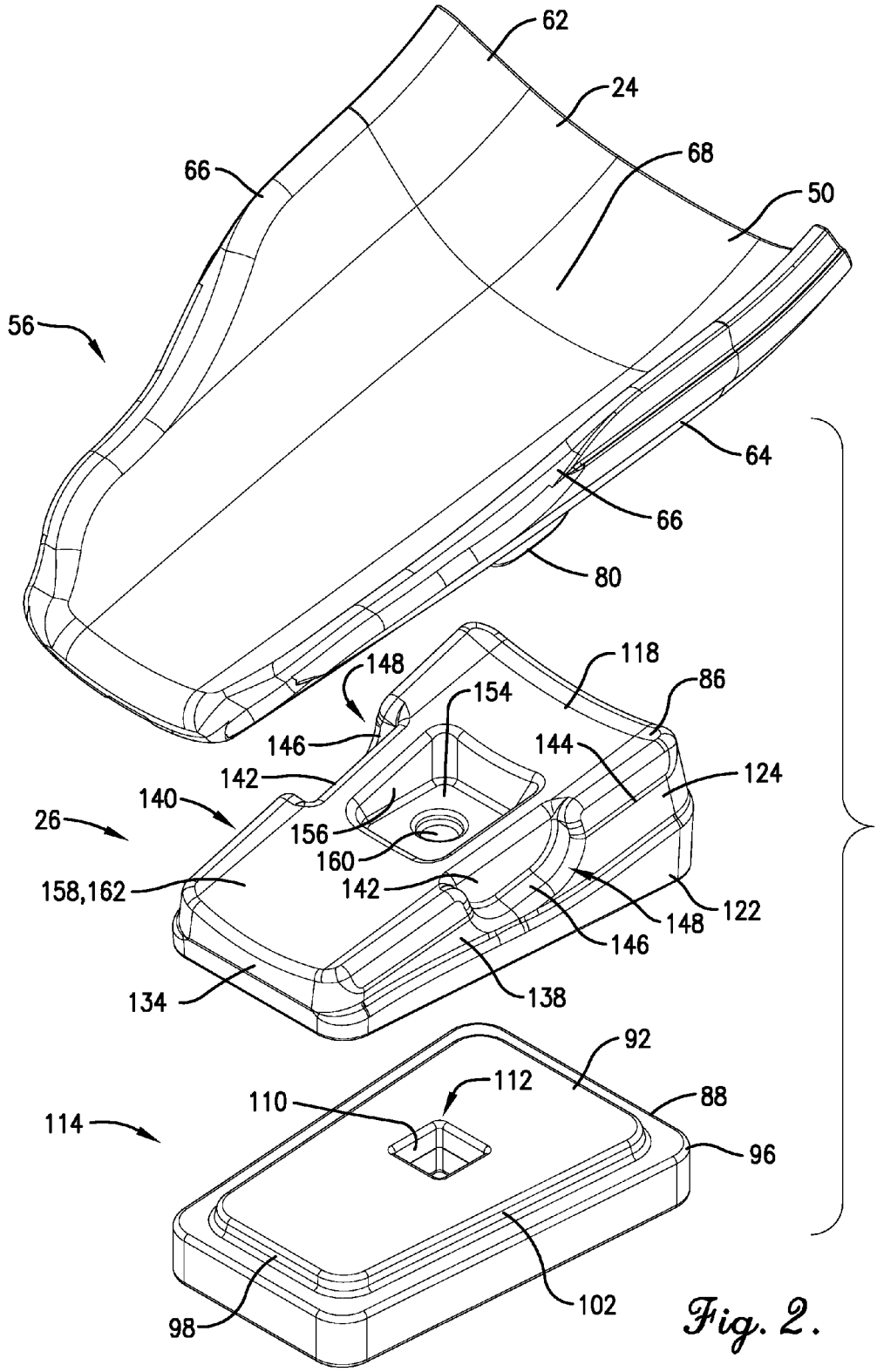
FIG. 2 is a fragmentary upper exploded view of the playset shown in FIG. 1, showing the slide exit section, the base adapter, and the one standoff.
Figure 6:
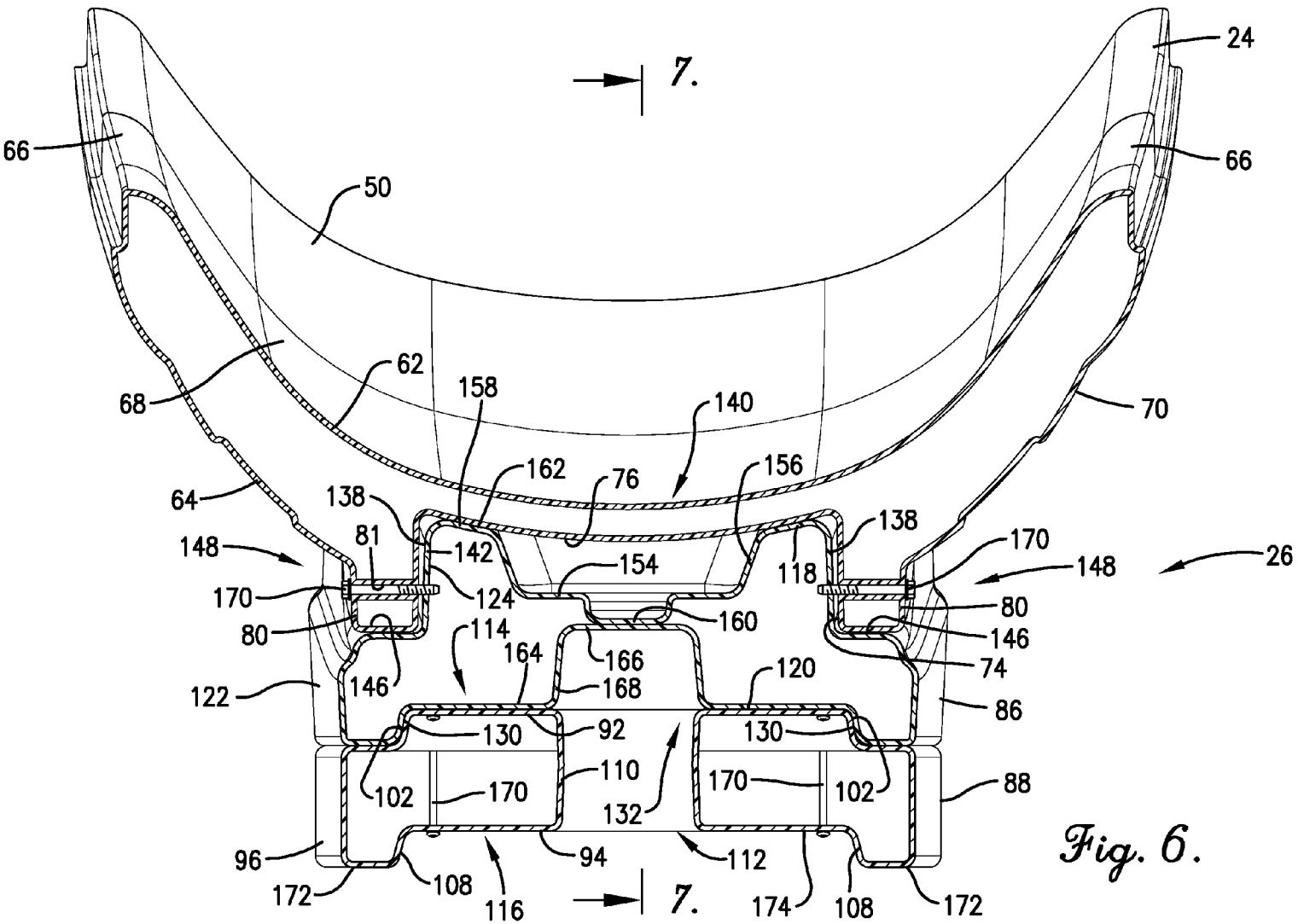
FIG. 6 is a fragmentary cross-section of the playset taken along line 6-6 in FIG. 4.

Turning to FIGS. 2 and 6, the sidewall 124 includes inwardly offset portions 142 spaced laterally inwardly from adjacent side portions 144 of the sidewall 124 and longitudinally between fore and aft portions of the sidewall 124. The sidewall 124 further includes U-shaped shoulders 146 that extend laterally between the portions 142,144. The offset portion 142 and shoulder 146 cooperatively present a pocket 148 that is operable to receive a corresponding tab 80.

Figure 7:
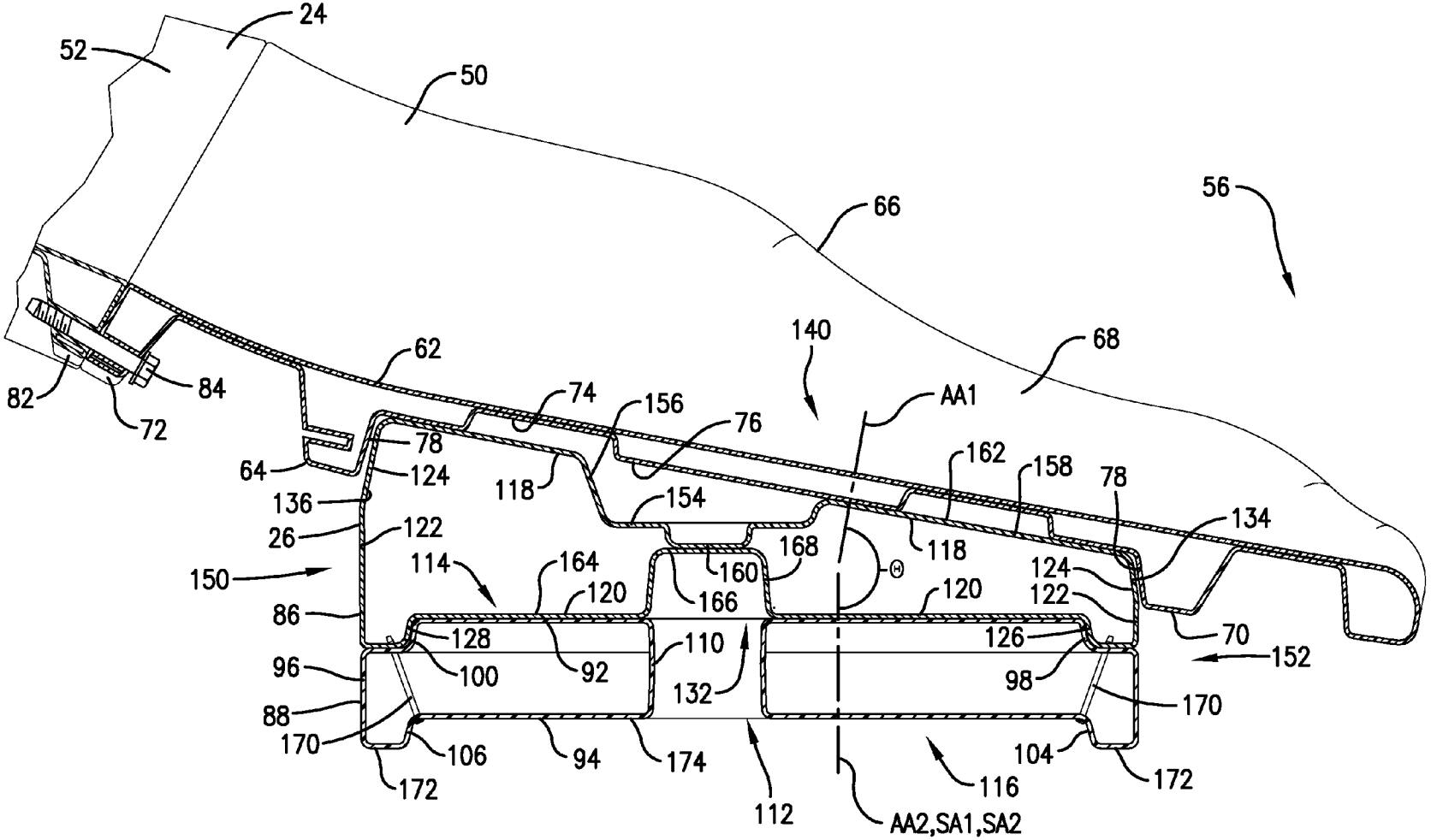
FIG. 7 is a fragmentary cross-section of the playset taken along line 7-7 in FIG. 6.
Figure 9:
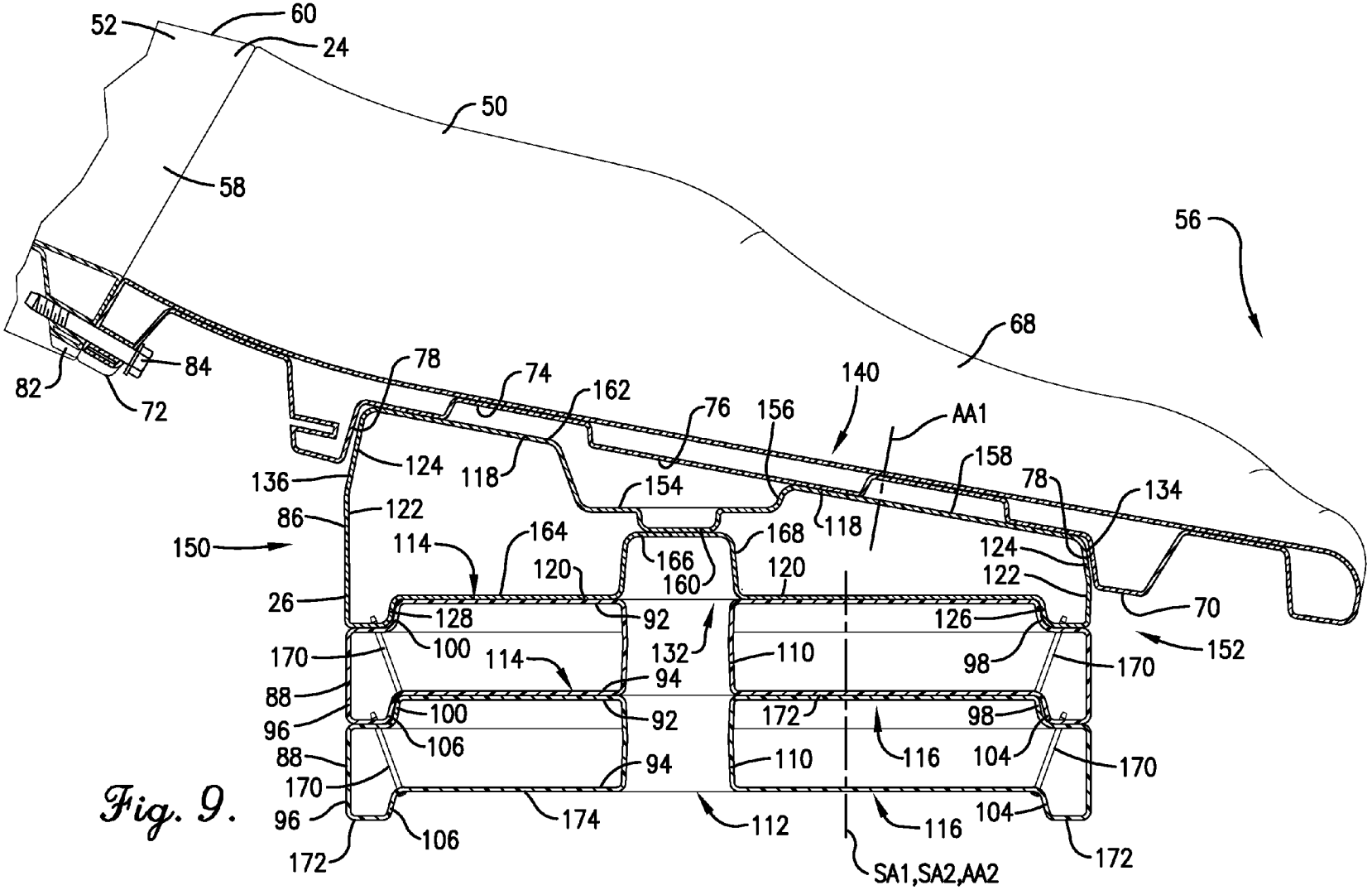
FIG. 9 is a fragmentary cross-section of the playset taken along line 9-9 in FIG. 8.

The sidewall 124 and flange 122 are configured so that the walls 118,120 taper toward each other in a forward direction from an aft margin 150 of the adapter 86 to a fore margin 152 of the adapter 86 (see FIGS. 7 and 9). In particular, the sidewall 124 and flange 122 each present a height that tapers forwardly from the aft margin 150 to the fore margin 152. Consequently, the normal adapter axes AA1,AA2 present an angle θ therebetween that preferably ranges between about one hundred thirty-five (135) and one hundred eighty (180) degrees (see FIG. 7). More preferably, the angle θ ranges between about one hundred fifty (150) and one hundred seventy-five (175) degrees. The sidewall 124 and flange 122 also present a width that tapers in the forward direction from the aft margin 150 to the fore margin 152.

Turning to FIGS. 2, 6, and 7, the upper wall 118 includes a central recessed portion 154 and an endless shoulder 156 that connects the recessed portion 154 to an exit-engaging body portion 158. The recessed portion 154 presents a square body and a circular support 160 depending from the square body. The body portion 158 also presents a curved face 162 that surrounds the shoulder 156.

Figure 3:
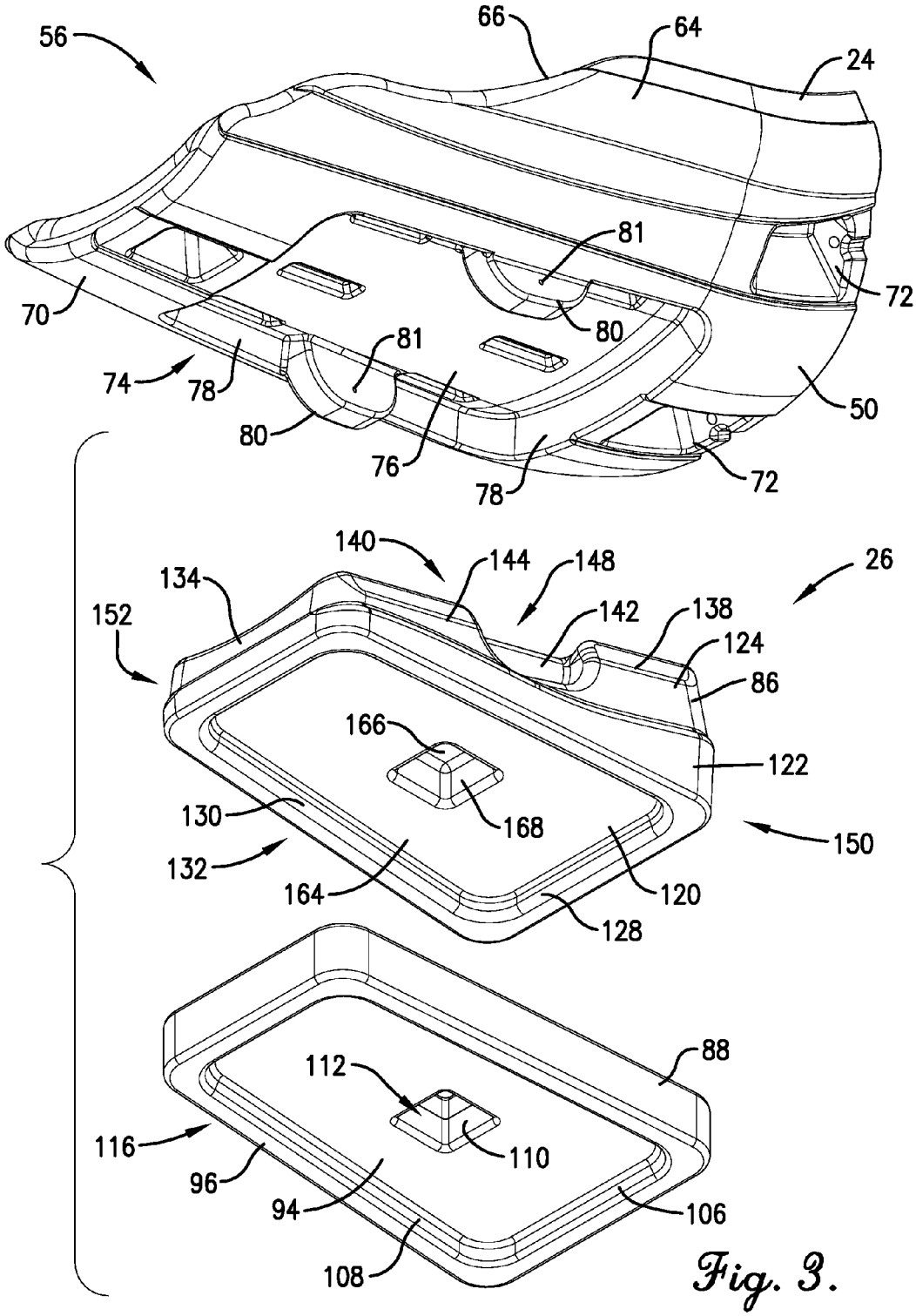
FIG. 3 is a fragmentary lower exploded view of the playset shown in FIGS. 1 and 2, showing the slide exit section, the base adapter, and the one standoff.

Turning to FIGS. 3, 6, and 7, the lower wall 120 includes a body portion 164, a support portion 166 spaced above the body portion 164, and a tube portion 168 that interconnects the body portion 164 and circular support 166. The circular supports 160,166 preferably engage each other to support the upper wall 118 above the lower wall 120 (see FIGS. 6 and 7).

While the adapter 86 preferably comprises a unitary construction, it is also consistent with the principles of the present invention where the adapter includes multiple components that are attached to present adapter ends 132,140 and thereby present the angle θ. Moreover, the adapter 86 could also include adjustable components that permit the angle θ to be adjusted within a range of available angles.

The adapter 86 is positioned below the exit section 50 by inserting the upper male adapter end 140 into the socket 74, with the fore margin 152 being positioned adjacent the fore end of the exit section 50 and the aft margin 150 being positioned adjacent the aft end of the exit section 50. The male adapter end 140 is inserted into the socket 74 until the curved face 162 of upper wall 118 engages the convex adapter surface 76 presented by lower wall 64 (see FIGS. 6 and 7). Yet further, the shoulders presented by the sidewall 124 are positioned adjacent to corresponding shoulders 78 presented by the slide exit section 50, with the shoulders 78 preferably surrounding the male adapter end 140 to restrict relative lateral movement between the adapter 86 and the exit section 50. It is also within the scope of the present invention where the adapter 86 presents a socket and the exit section 50 presents a male end, with the male end operable to be inserted into the socket of the adapter 86 to provide interengagement between the adapter 86 and exit section 50.

Figure 4:
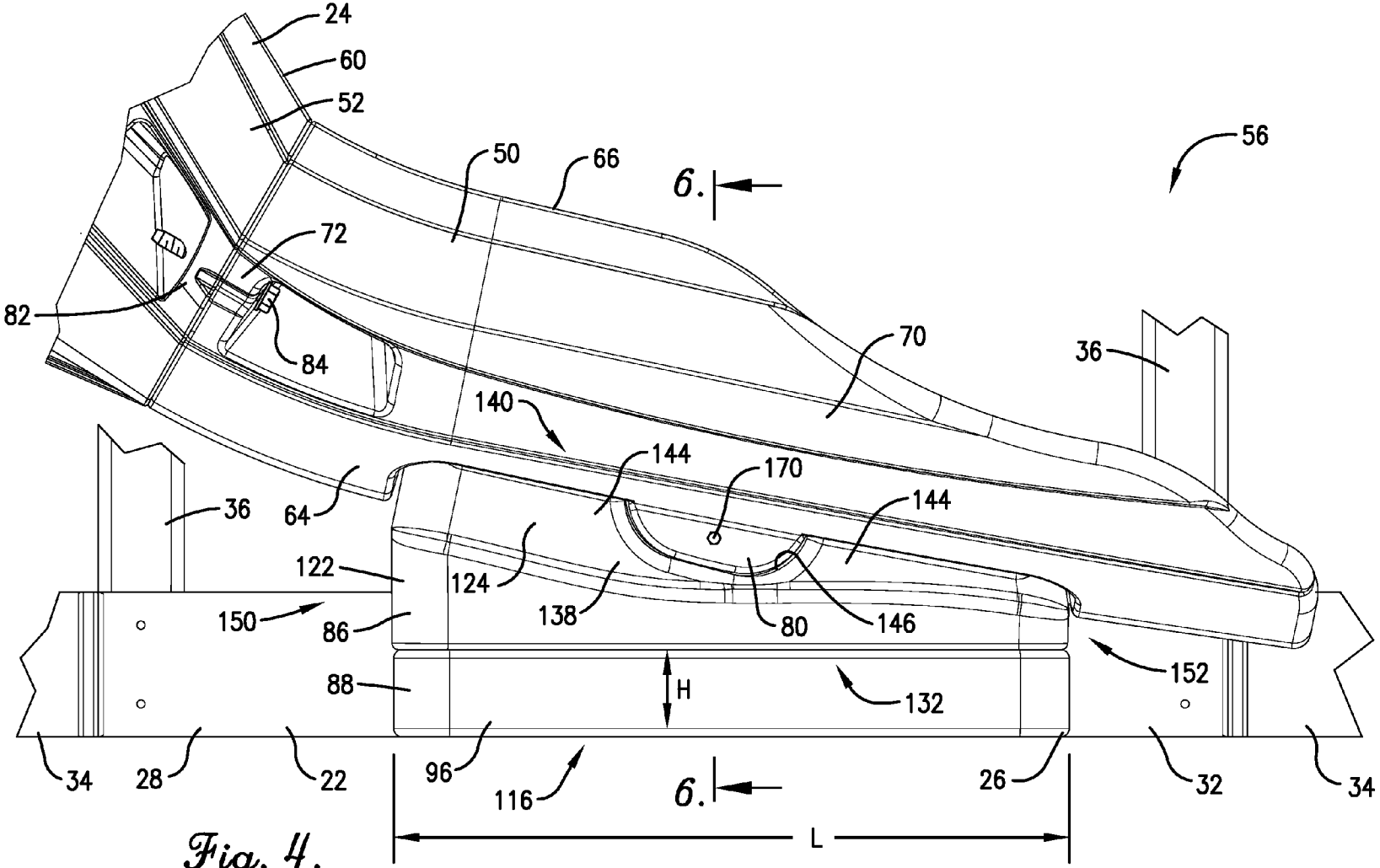
FIG. 4 is a fragmentary side elevation of the playset shown in FIGS. 1-3, showing the slide exit section supported on the ground by the base adapter and the one standoff and attached to a distal-most one of the intermediate slide sections.

As the adapter 86 engages the exit section 50, the tabs 80 are received in corresponding pockets 148 and are secured to the adapter 86 by inserting fasteners 170 through holes 171 in the tabs 80 and into the offset portion 142 of the sidewalls 124 (see FIGS. 3, 4, and 6). As discussed above, it is also within the scope of the present invention where the adapter 86 includes tabs that are received by the exit section 50. Furthermore, the exit section 50 could present pockets that receive corresponding tabs of the adapter 86. Yet further, it is within the ambit of the present invention where alternative interengaging features are used to secure the adapter 86 and exit section 50 to each other.

Figure 5:
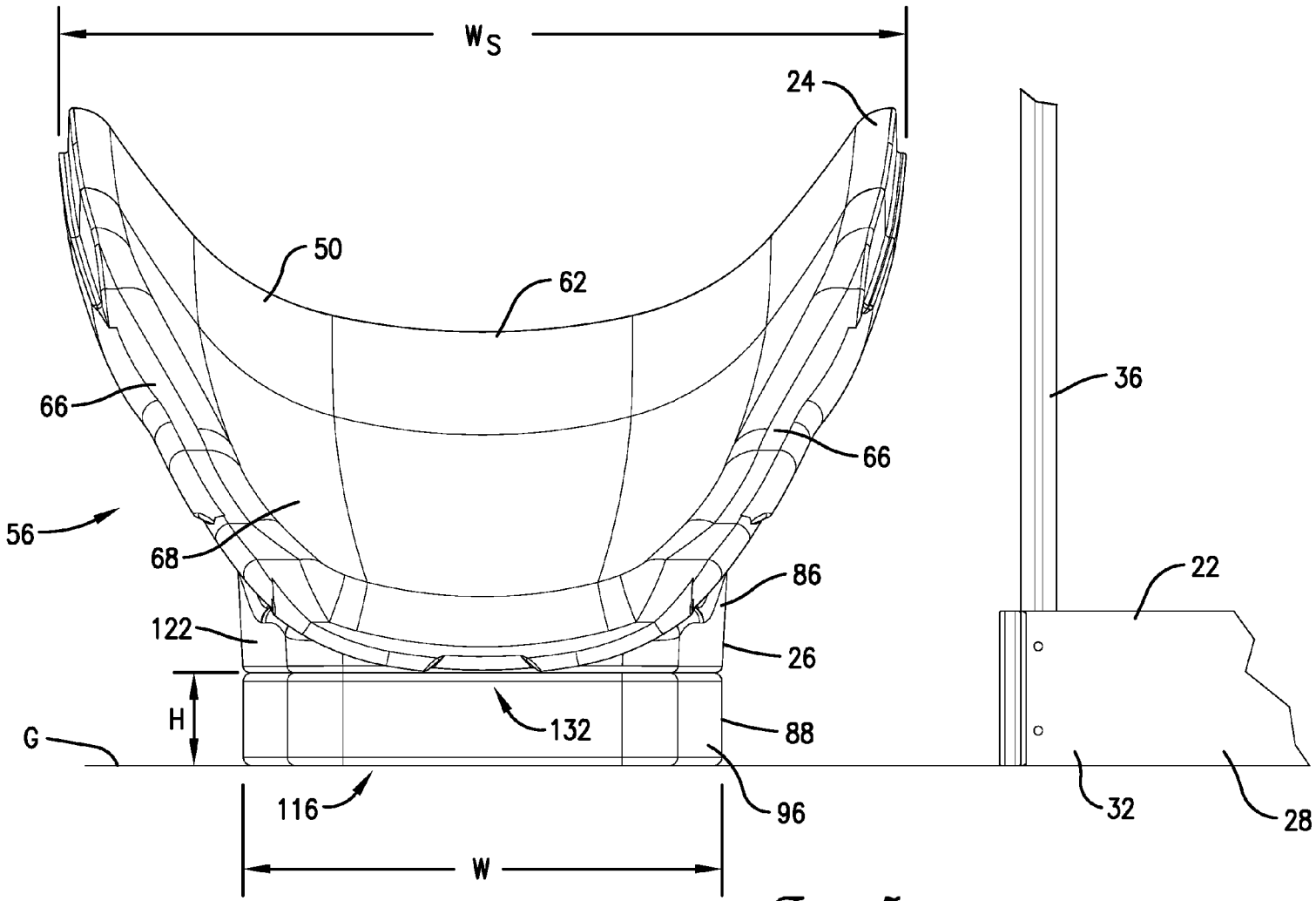
FIG. 5 is a fragmentary front elevation of the playset shown in FIGS. 1-4, showing the slide exit section supported on the ground by the base adapter, with the playset being erected on a substantially flat and level surface of ground.

The adapter 86 preferably presents a maximum width and maximum length that are substantially identical to width W and length L of the standoffs 88 to provide a broad footprint that promotes stability and restricts lateral and fore-and-aft tilting of the slide 24 relative to ground G (see FIGS. 4-6). Furthermore, the curved face 162 of the adapter 86 presents a maximum face width and maximum face length that are preferably between about one-half of the maximum cross-sectional width Ws of the slide 24 and the full width Ws. As a result, the weight of the slide and a person on the slide is distributed over the large engagement area between the exit section 50 and adapter 86, which increases the durability and usable life of the slide 24 and slide base 26. It has been found that this dimensional configuration particularly permits the adapter 86 to have a thin-walled construction that can be made using conventional blow-molding techniques.

The adapter 86 is secured to one of the standoffs 88 by inserting the male standoff end 114 into the female adapter end 132. The male standoff end 114 is inserted until an outwardly facing surface of the upper wall 92 of the standoff 88 engages the lower wall 120 of the adapter 86. Furthermore, shoulders 126,128,130 of the adapter 86 engage corresponding shoulders 98,100,102 of the standoff 88. Yet further, an upwardly facing surface of the flange 96 of the standoff 88 engages the flange 122 of the adapter 86. The adapter 86 is also preferably positioned so that the opening presented by the tube portion 168 is substantially aligned with the central opening 112 of the standoff 88. It is also consistent with the principles of the present invention where the lower end of adapter 86 includes a male end (as opposed to the female adapter end 132) and the standoff 88 presents an upper female end (as opposed to the male standoff end 114) that removably receives the male end of the adapter 86. Furthermore, the adapter 86 and standoffs 88 could include other features to provide removable interengagement therebetween.

The adapter 86 and standoff 88 are secured by fore and aft pairs of fasteners 170 that extend upwardly through the lower wall 94 adjacent the corresponding lower fore and aft shoulders 104,106, through an upper wall of the flange 96 of the standoff 88, and through a lower wall of the flange 122 of the adapter 86 (see FIGS. 6 and 7). With the adapter 86 and standoff 88 interengaged with each other, the lower normal adapter axis AA2 and the upper standoff axis SA1 are preferably aligned so that the adapter 86 and standoff 88 cooperatively present a common connection axis parallel to axes AA2,SA1, with the adapter 86 and standoff 88 configured to move into and out of interengagement along the connection axis. However, the principles of the present invention are applicable where the adapter 86 and standoff 88 are constructed for shifting into and out of engagement along a different axis. For instance, the adapter 86 and standoff 88 could have ends with a laterally extending tongue-and-groove construction that permits the adapter 86 and standoff 88 to be shiftable into and out of engagement along an axis transverse to the axes AA2,SA1.

Turning again to FIGS. 2-7, with the adapter 86 and the slide 24 secured thereto, the female standoff end 116 is configured so that the standoff 88 stands on a flat and level surface of ground G in an unsunken configuration (i.e., no part of the standoff 88 is sunken beneath the ground surface). Specifically, an endless, lowermost, downwardly-facing flange surface 172 of flange 96 engages the ground surface and presents the normal site-engaging standoff axis SA2. In the illustrated embodiment, the shoulders 104,106,108 and an outwardly facing surface of the lower wall 94 are spaced from the ground surface and cooperatively present an open socket 174 that is surrounded by the lowermost flange surface 172.

The flange surface 172 provides stable frictional engagement with the ground G. The construction of the lower part of the flange 96 and the open socket 174 also permits the standoff 88 to be sunk into the ground G in a sunken configuration (not shown) while maintaining stable and secure engagement between the standoff 88 and the ground G. More particularly, the shoulders 104,106,108 and the outwardly facing surface of the lower wall 94 can also engage the ground G as the standoff 88 is sunk into the ground G. Thus, where the standoff 88 is at least partly sunken into ground G, the lower surfaces of the female standoff end 116 provide further interengagement between the standoff 88 and ground G.

Figure 8:
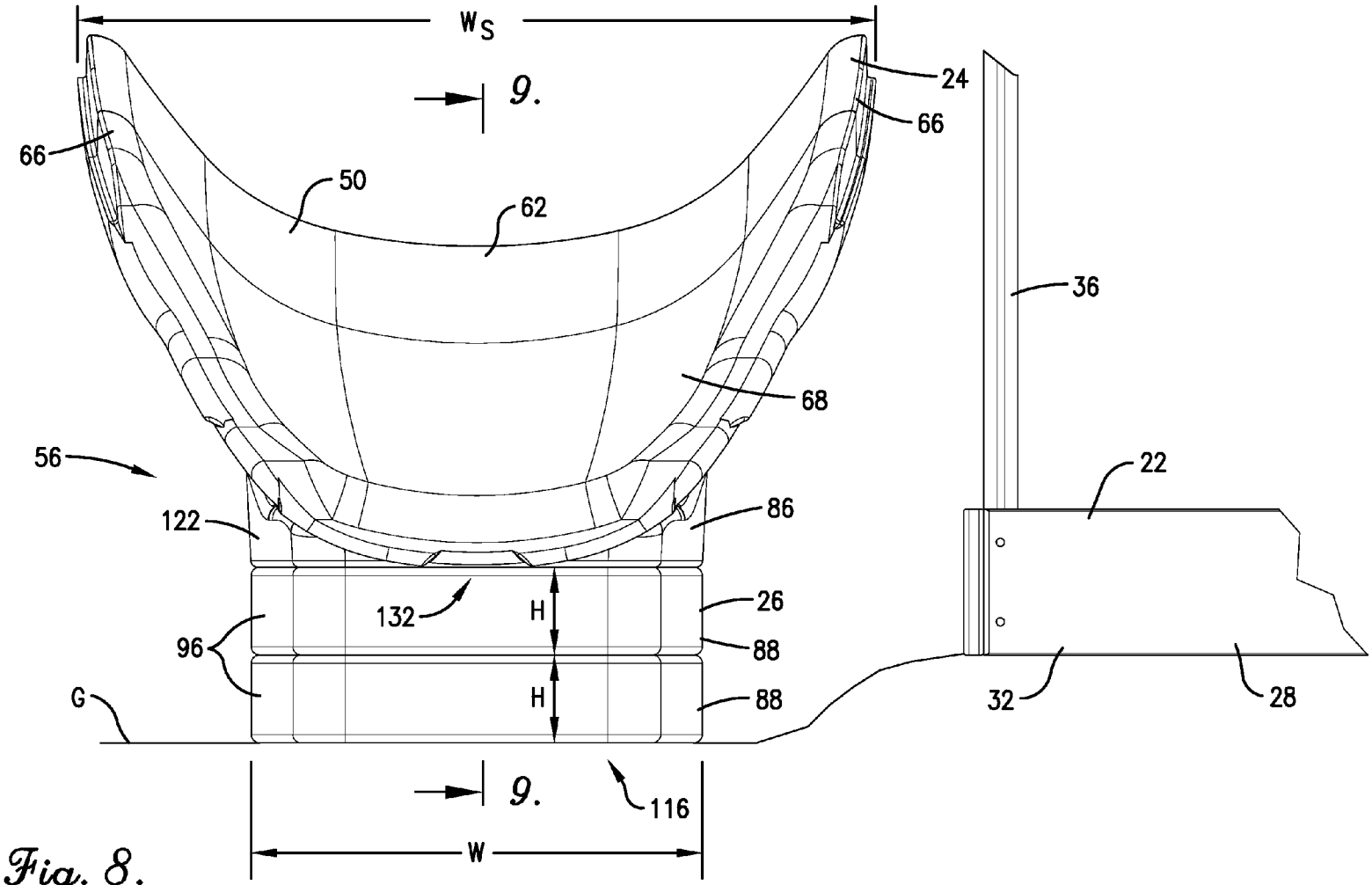
FIG. 8 is a fragmentary front elevation of the playset shown in FIGS. 1-7, showing a pair of standoffs installed below the base adapter, with the tower of the playset being erected on a first ground surface and the slide base erected on a second ground surface lower than the first ground surface.

Turning to FIGS. 8 and 9, a pair of adjacent standoffs 88 can be interconnected in a stacked configuration to provide greater vertical spacing of the adapter 86 above an undulating surface of ground G. In particular, the male standoff end 114 of a lower one of the standoffs 88 can be inserted into the open socket 174 of the female standoff end 114 of an upper one of the standoffs 88. In this configuration, the upper shoulders 98,100,102 of the lower standoff 88 engage respective lower shoulders 104,106,108 of the upper standoff 88 to restrict relative lateral movement between the standoffs 88. Furthermore, the upper wall 92 and upper surface of flange 96 of the lower standoff 88 engage the lower wall 94 and lower surface of flange 96 of the upper standoff 88. Fore and aft pairs of fasteners 170 extend upwardly through the lower wall 94 of lower standoff 88 adjacent the corresponding lower fore and aft shoulders 104,106, through an upper wall of the flange 96 of the lower standoff 88, and through a lower wall of the flange 96 of the upper standoff 88.

The female adapter end 132 presents a shape that is substantially identical to the female standoff ends 116 of standoffs 88. Thus, the male and female standoff ends 114,116 of each standoff 88 are preferably substantially identically shaped compared to the ends 114,116 of the other standoff 88, each of the illustrated standoffs 88 are preferably operable to be attached directly to the adapter 86 or beneath the other standoff 88 (i.e., the standoffs 88 can be interchangeably positioned beneath the adapter 86). For some aspects of the present invention, the standoffs 88 could be stackable beneath the adapter 86 but not interchangeably positionable.

With the standoffs 88 interengaged with each other, the lower standoff axis SA2 of the upper standoff 88 and the upper standoff axis SA1 of the lower standoff 88 are preferably aligned so that the standoffs 88 cooperatively present a common standoff connection axis parallel to axes SA1,SA2, with the standoffs 88 configured to move into and out of interengagement along the standoff connection axis. However, the principles of the present invention are applicable where the standoffs 88 present ends that are constructed for shifting into and out of engagement along a different axis. For instance, the standoffs 88 could have ends with a laterally extending tongue-and-groove construction that permits the standoffs 88 to be shiftable into and out of engagement along an axis transverse to the axes SA1,SA2.

While the illustrated slide base 26 includes a pair of standoffs 88 that are selectively attached to the slide 24, it is also within the ambit of the present invention where the slide base 26 includes more than two standoffs 88 that can be stacked on top of each other to customize the height of the slide base 26 depending on site conditions. It has been determined that the illustrated configuration of slide base 26 permits the playset 20 to be quickly and stably erected without extensive site preparation, such as excavation work to level the ground, providing a layer of aggregate, or providing a concrete slab.

In operation, the playset 20 is erected on a site by assembling the tower 22 above the ground G. The slide 24 is also assembled and the upper end 54 of slide 24 is attached to and supported by the tower 22. The lower end 56 of the slide 24 is supported by inserting the slide base 26 between the lower end 56 and the ground G. In particular, the adapter 86 is inserted into the socket 74 presented by the exit section 50, with the tabs 80 inserted into corresponding pockets 148 of the adapter 86. The adapter 86 is fastened into engagement with the exit section 50 by fasteners 170. The slide installer can then measure the space between the ground G and the lowermost surface 86 of the adapter 86, and based on the height of each standoff 88, select the number of standoffs 88 to be installed beneath the adapter 86. If one standoff 88 is sufficient to space the adapter 86 above the ground G and support the slide 24, the standoff 88 is inserted into the female adapter end 132 and secured to the adapter 86 with fasteners 170. Where standoffs 88 present different heights H, the slide installer could select one of the standoffs 88 with the height dimension that most closely corresponds to the measured spacing between the adapter 86 above the ground G. If both standoffs 88 are required to space the adapter 86 above the ground G and support the slide 24, the standoffs 88 can be fastened to each other with fasteners 170 in the stacked configuration and the upper one of the standoffs 88 can be attached to the adapter 86. The slide installer can also selectively insert standoffs 88 beneath the adapter 86 without measuring the space between the ground G and adapter 86 until the slide 24 is suitably supported and then fasten the desired number of standoffs 88 to the adapter 86.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A slide assembly operable to be erected on a site, said slide assembly comprising:

a slide including a slide section and presenting upper and lower ends associated with slide ingress and egress; and an adjustable-height slide base supporting the slide section and including an intermediate adapter and a lower standoff stacked in series with the slide section, said slide section presenting a lower adapter-mating surface, said adapter presenting upper and lower adapter ends, with the upper adapter end being removably mated with the lower adapter-mating surface to be interengaged and generally extend along a common adapter axis, said standoff presenting opposite upper and lower standoff ends, with the lower adapter end and the upper standoff end being removably attached relative to one another, said standoff including a lowermost site-engaging surface that presents a normal site-engaging axis generally normal thereto, with the site-engaging axis being angularly offset from the adapter axis, said upper standoff end and said lower adapter end being removably interengaged and generally extending along a common intermediate connection axis that is angularly offset from the adapter axis, with the adapter comprising a unitary wedge-shaped foot presenting fore and aft margins, said adapter including upper and lower walls that taper toward each other between the fore and aft margins, said slide section including upper and lower slide section walls, with the lower slide section wall presenting the lower adapter-mating surface, one of said lower slide section wall and said upper adapter end presenting a socket and the other of said lower slide section wall and said upper adapter end including a male projection that is received by the socket.

2. The slide assembly as claimed in claim 1, said upper and lower walls being fixed relative to each other so that the angular offset between the adapter axis and intermediate connection axis is substantially fixed.

3. The slide assembly as claimed in claim 1, one of said lower slide section wall and said adapter including spaced apart vertically projecting tabs positioned adjacent opposite sides of the socket and extending to a point spaced vertically from the socket, the other of said lower slide section wall and said adapter including laterally spaced sidewalls that extend between the upper and lower walls of the adapter, said sidewalls each including a main wall section and an offset section spaced laterally inwardly from the main wall section, with the sidewall thereby presenting an open relief pocket that receives a corresponding tab therein.

4. The slide assembly as claimed in claim 3, said pocket and said tab being complementally shaped.

5. The slide assembly as claimed in claim 1, said adjustable slide base including a second standoff removably attached relative to the first-mentioned standoff, said second standoff presenting opposite upper and lower second standoff ends.

6. The slide assembly as claimed in claim 5, said second standoff being removably stacked with the first-mentioned standoff so that corresponding standoff ends are removably interengaged.

7. The slide assembly as claimed in claim 6, said interengaged standoff ends extending generally along a common standoff connection axis substantially parallel with the site-engaging axis.

8. The slide assembly as claimed in claim 7, said upper standoff ends being substantially identical to each other and said lower standoff ends being substantially identical to each other so that the standoffs are interchangeable with one another.

9. The slide assembly as claimed in claim 1, said slide section, adapter, and standoff comprising hollow, blow-molded components.

10. The slide assembly as claimed in claim 1, said slide section presenting the lower end of the slide and thereby comprising a slide exit section that permits slide egress from the lower end.

11. The slide assembly as claimed in claim 1, said adjustable slide base including at least one additional standoff, with the at least one additional standoff and the first-mentioned standoff having the same vertical dimension as measured between the upper and lower standoff ends of the corresponding standoff.

12. The slide assembly as claimed in claim 11, said standoffs being substantially identical to each other so that the standoffs are interchangeable.

13. A slide assembly operable to be erected on a site, said slide assembly comprising:

a slide including a slide section and presenting upper and lower ends associated with slide ingress and egress; and an adjustable-height slide base supporting the slide section and including an intermediate adapter and a lower standoff stacked in series with the slide section, said slide section presenting a lower adapter-mating surface, said adapter presenting upper and lower adapter ends, with the upper adapter end being removably mated with the lower adapter-mating surface to be interengaged and generally extend along a common adapter axis, said standoff presenting opposite upper and lower standoff ends, with the lower adapter end and the upper standoff end being removably attached relative to one another, said standoff including a lowermost site-engaging surface that presents a normal site-engaging axis generally normal thereto, with the site-engaging axis being angularly offset from the adapter axis, said slide section presenting a maximum cross-sectional slide width measured transversely relative to the length of the slide, said standoff presenting a maximum standoff width that ranges between about the slide width and about one-half the slide width.

14. The slide assembly as claimed in claim 13, said upper standoff end and said lower adapter end being removably interengaged and generally extending along a common intermediate connection axis that is angularly offset from the adapter axis, with the adapter comprising a unitary wedge-shaped foot presenting fore and aft margins, said adapter including upper and lower walls that taper toward each other between the fore and aft margins.

15. The slide assembly as claimed in claim 13, said standoff presenting a stacking height that ranges in dimension from about the standoff width to about one-tenth of the standoff width.

* * * * *